US006645033B1

(12) United States Patent
Thomsen

(10) Patent No.: US 6,645,033 B1
(45) Date of Patent: Nov. 11, 2003

(54) BUILDING ELEMENT FOR A TOY BUILDING SET

(75) Inventor: Sven Thomsen, Næstved (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/889,384

(22) PCT Filed: Jan. 12, 2000

(86) PCT No.: PCT/DK00/00008

§ 371 (c)(1),
(2), (4) Date: Oct. 9, 2001

(87) PCT Pub. No.: WO00/41791

PCT Pub. Date: Jul. 20, 2000

(30) Foreign Application Priority Data

Jan. 15, 1999 (DK) ..... 1999 00037

(51) Int. Cl.[7] ..... A63H 33/06
(52) U.S. Cl. ..... 446/120; 446/124
(58) Field of Search ..... 446/85, 117, 120, 446/121, 125, 126, 127, 128, 124

(56) References Cited

U.S. PATENT DOCUMENTS

| | | | | |
|---|---|---|---|---|
| 3,234,683 A | | 2/1966 | Christiansen | |
| 3,570,170 A | * | 3/1971 | Kishi | 446/128 |
| 4,964,833 A | * | 10/1990 | Suzuki | 446/118 |
| 5,661,941 A | * | 9/1997 | Vataker | 52/604 |
| 5,848,927 A | * | 12/1998 | Frederiksen | 446/128 |
| 6,050,044 A | * | 4/2000 | McIntosh | 52/591.1 |
| 6,200,187 B1 | * | 3/2001 | Olsen et al. | 446/122 |
| 6,447,360 B1 | * | 9/2002 | Sorensen | 446/124 |
| 6,554,676 B1 | * | 4/2003 | Bach | 446/116 |

FOREIGN PATENT DOCUMENTS

| | | | |
|---|---|---|---|
| DE | 1202694 | | 10/1965 |
| DK | 131093 | | 5/1975 |
| DK | 170833 B1 | | 2/1996 |
| FR | 1415559 | | 9/1965 |
| GB | 1231489 | | 5/1971 |
| GB | 2136700 | * | 4/1972 |

* cited by examiner

*Primary Examiner*—Jacob K. Ackun
*Assistant Examiner*—Faye Francis
(74) *Attorney, Agent, or Firm*—Pitney, Hardin, Kipp & Szuch LLP

(57) ABSTRACT

A building element for a toy building set comprising a plurality of such building elements, said building elements comprising a box-shaped body part having a surface with a top side and an underside, and a plurality of side faces extending downwards from the underside of the surface, a plurality of coupling flanges being arranged between the side faces, said coupling flanges extending downwards from the surface at a distance which is smaller than the distance at which the side faces extend from the surface, a plurality of coupling studs being arranged on the top side of the surface, each of said coupling studs having a top face positioned at a height above the top side of the surface which is greater than the difference between the distance at which the coupling flanges and the side faces extend from the surface, said coupling studs, coupling flanges and side faces being shaped such that the coupling studs of a building element engage, face-to-face, both the coupling flanges and the side faces of another building element after interconnection of these, a plurality of engagement means being arranged between the coupling flanges and the side faces, said engagement means being shaped and positioned in such a manner that they form an engagement face which engages the top face of the coupling studs upon interconnection of two building elements.

8 Claims, 3 Drawing Sheets

BUILDING ELEMENT FOR A TOY BUILDING SET

The present invention relates to a building element for a toy building set comprising a plurality of such building elements, said building elements comprising a box-shaped body part having a surface with a top side and an underside, and a plurality of side faces extending downwards from the underside of the surface, a plurality of coupling flanges being arranged between the side faces, said coupling flanges extending downwards from the surface at a distance which is smaller than the distance at which the side faces extend from the surface, a plurality of coupling studs being arranged on the top side of the surface, each of said coupling studs having a top face positioned at a height above the top side of the surface which is greater than the difference between the distance at which the coupling flanges and the side faces extend from the surface, said coupling studs, coupling flanges and side faces being shaped such that the coupling studs of a building element, when said building element is interconnected with another corresponding building element, engage both the coupling flanges and the side faces of another building element after interconnection of these.

GB Patent No. 1 231 489 discloses a toy building set comprising such building elements. The purpose of the coupling flanges extending from the surface at a smaller distance from the underside of the surface with respect to the corresponding distance of the side flanges is that the building element may hereby be mounted on top of building elements which are provided with coupling studs of other shapes, so that e.g. building elements of different types having a different distance between the coupling studs may be interconnected without the coupling flanges making the interconnection impossible.

In such building sets it is important that all building elements of the building set comply with fixed modular measures which characterize the building set, such as a fixed modularized height, width and length of the body parts of the building elements, as well as a fixed modularized distance between the individual coupling studs, side flanges and coupling flanges. This is required to ensure that the building set allows different models to be built in an easy manner.

A problem of the above-mentioned known building elements, however, is that just the side faces form an engagement face which, upon interconnection of the building elements, creates the correct modular height of the individual building element, so that if two building elements are interconnected staggered from each other such that one building element only engages a single side flange of the other building element, then an oblique and unstable interconnection will be the result.

It has been attempted to solve this in GB Patent No. 1 231 489 by providing the coupling flanges with a plurality of pins which extend in extension of the coupling flanges until they are flush with the plane which is formed by the side flanges. The above-mentioned drawback is remedied hereby, but a problem of this solution is that this embodiment can only be used for the interconnection of another type of elements having a single type of coupling studs, and that the protruding pins of the coupling flanges form undesired, relatively sharp edges.

Accordingly, the object of the present invention is to provide a building element for a toy building set of the type mentioned in the opening paragraph, which may be interconnected with building elements of another type without this making special demands on the shape of the coupling studs on the other type of building element, while achieving a stable and correct interconnection of two uniform building elements which do not overturn with respect to each other upon interconnection.

This is achieved according to the invention by a building element of the type mentioned in the opening paragraph, said building element being unique in that a plurality of engagement means is arranged between the coupling flanges and the side faces, said engagement means being shaped and positioned in such a manner that they form an engagement face which engages the top face of the coupling studs upon interconnection of two building elements.

The building element according to the present invention comprises at least four coupling studs, and the coupling studs are preferably positioned in a square pattern.

A particularly stable interconnection is achieved if the top face of the coupling studs is substantially plane and parallel with the surface of the building element.

In a preferred embodiment of the invention, the coupling flanges are shaped as tubes positioned such that, upon interconnection of a first building element on which they are positioned and a second building element, they engage and extend down between four adjacent coupling studs on the second building element.

The engagement means preferably comprise a plurality of engagement flanges which extend from the underside of the surface and downwards at a distance which corresponds to the difference between the distance of the side faces from the surface and the height of the coupling studs.

In addition, the engagement faces may advantageously be directly connected with the coupling flanges and extend at an angle out from these, so as to achieve a stable interconnection of two interconnected elements, in that the engagement means are positioned relatively remotely from the side flanges of the building element.

In a further preferred embodiment, the engagement flanges are positioned at the point on the coupling flanges where the coupling studs touch the coupling flanges upon interconnection of two building elements according to the invention.

In this connection, the building elements may advantageously have coupling studs which are shaped as substantially cylindrical tubes.

The invention will be described more fully below with reference to the drawing, in which.

Figure 1:
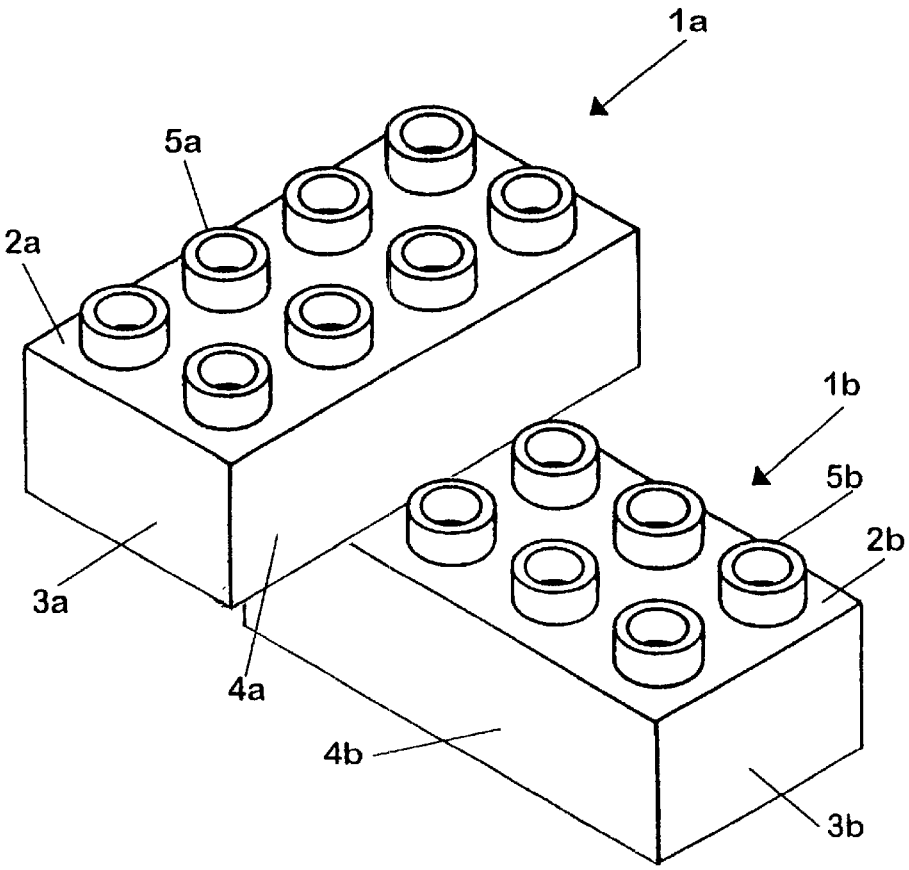
FIG. 1 is a perspective view showing two interconnected building elements seen obliquely from above.

Thus, FIG. 1 shows a connection of a first known building element 1*a* and a second building element 1*b* according to the present invention, which each have a box-shaped body part formed by a surface 2*a*, 2*b* and a plurality of side faces 3*a*, 3*b*, 4*a*, 4*b*. The surface 2*a*, 2*b* is provided with eight coupling studs 5*a*, 5*b* in a known manner, which each are shaped as substantially cylindrical tubes.

Figure 2:
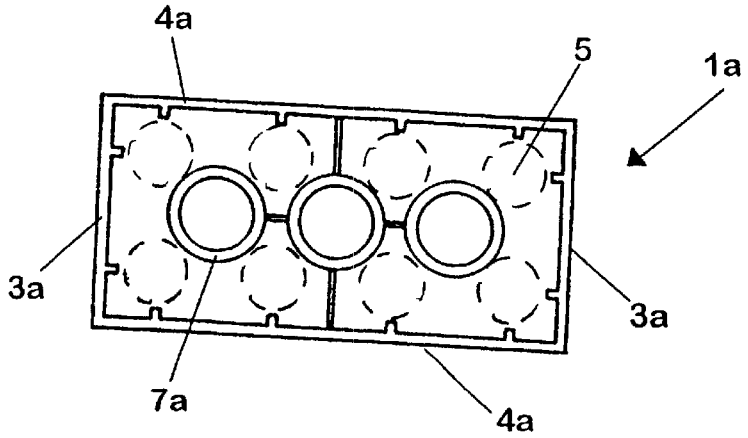
FIG. 2 is a view showing a known embodiment of the building elements shown in FIG. 1 seen from below.

In the connection of the building elements 1*a*, 1*b* shown in FIG. 1, two coupling studs 5*b* of the lower building element 1*b* are pressed into a cavity (not shown) below the upper building element 1 and here engage the side face 4*a* of the upper building element 1*a* and a plurality of coupling flanges (not shown) on the upper building element 1*a*. This will be described more fully below:

FIG. 2 shows a known embodiment of a building element la of the type shown in FIG. 1, but seen from below, it being illustrated that a plurality of coupling flanges 7*a* is arranged below the building element 1*a*, positioned such that the coupling studs 5 (shown in dashed line) of a second building element may be inserted between the tubular coupling flanges 7*a* and the side faces 3*a*, 4*a* and frictionally engage these, thereby achieving a frictional interconnection of the two building elements.

Figure 3:
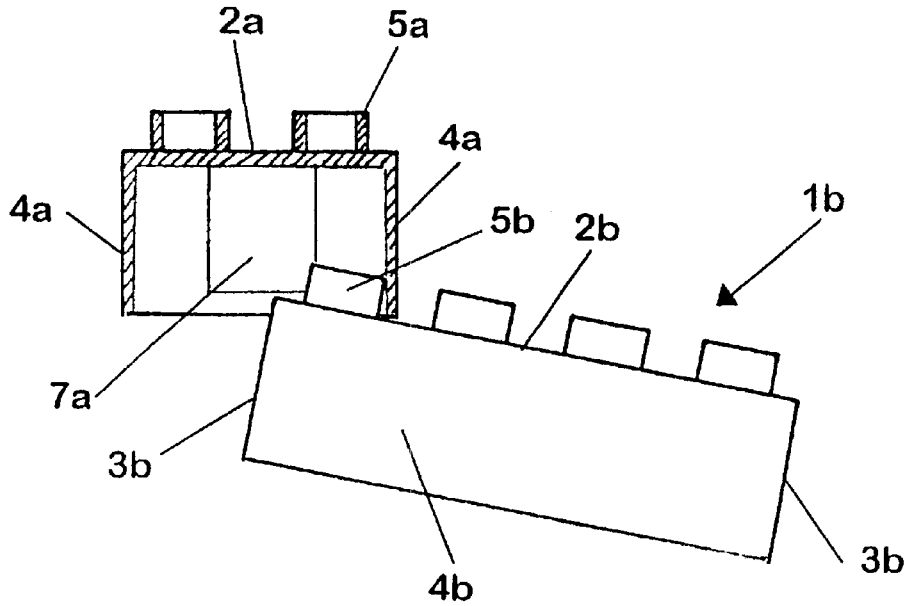
FIG. 3 is a partially sectional view of the connection of building elements shown in FIG. 1, where two known elements of the type shown in FIG. 2 are used for the connection.

FIG. 3 shows the specific connection in FIG. 1 as a partially sectional view, in which building elements of the known type shown in FIG. 2 are used. As will be seen, the tubular coupling flange 7*a* extends at a distance from the underside of the surface 2*a* at a distance which is smaller than the distance at which the side face 4*a* extends from the underside of the surface 2*a* on the upper building element 1*a*.

As will be seen in FIG. 3, the connection of the two building elements 1*a*, 1*b* is unstable because the surface 2*b* of the lower building element 1*a* engages the side face 4*a* as well as the tubular coupling flange 7*a* of the upper building element 1*a*, which is countersunk with respect to the side face 4*a* so that the two building elements 1*a*, 1*b* overturn with respect to each other upon interconnection.

Figure 4:
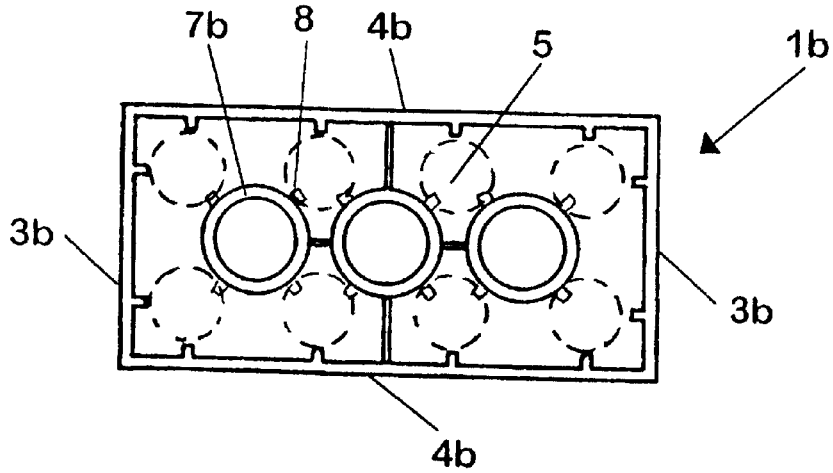
FIG. 4 shows one of the building elements shown in FIG. 1 in an embodiment of the present invention seen from below.

FIG. 4 shows an embodiment of a building element 1*b* according to the invention and of the type shown in FIG. 1, but seen from below, it being illustrated that a plurality of tubular coupling flanges 7*b* is arranged below the building element 1*b*, positioned such that the coupling studs 5 (shown in dashed line) of a second building element may be inserted between the tubular coupling flanges 7*b* and the side faces 3*b*, 4*b* and frictionally engage these, thereby achieving a frictional interconnection of the two building elements.

Figure 5:
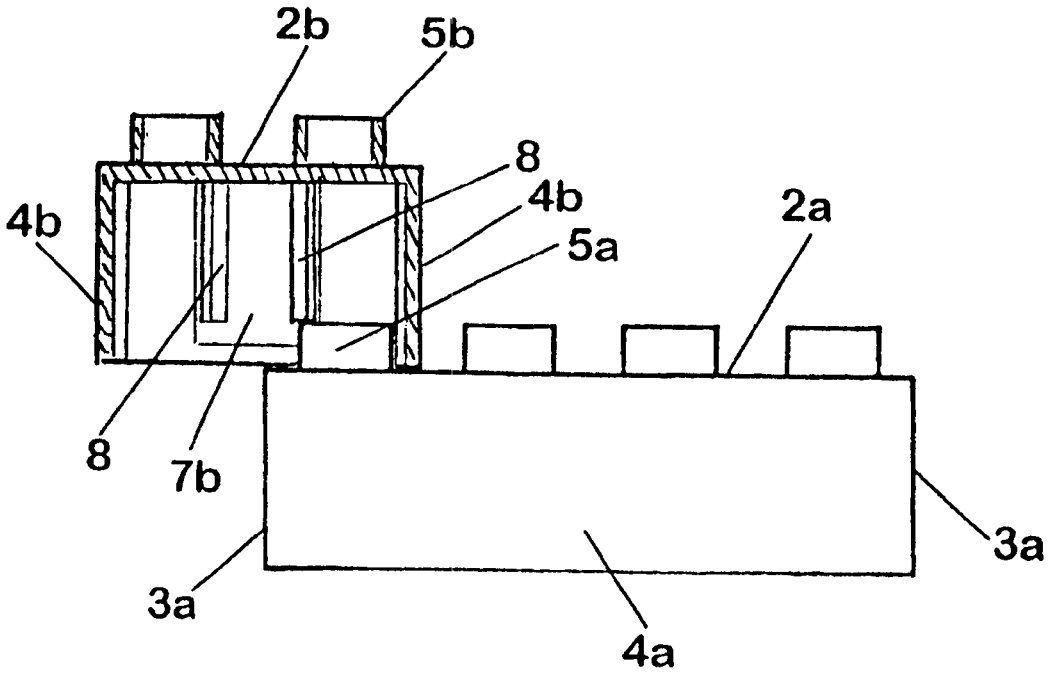
FIG. 5 is a partially sectional view of the connection of building elements shown in FIG. 1, but where building elements according to the invention and as shown in FIG. 4 are used for the connection.

According to the invention, the coupling flanges 7*b* are here provided with engagement flanges 8 which extend outwards from the tubular coupling flanges and engage the upper face of the coupling studs of the other building element, as is illustrated more fully in FIG. 5.

FIG. 5 shows that the upper building element 1*b* is formed by a building element according to the invention and thus has the above-mentioned engagement flanges 8, which form an engagement face countersunk with respect to the tubular coupling flanges 7*a* so that they form an abutment for the coupling studs of the lower building element 1*a*. It is hereby ensured according to the invention that this interconnection is stable and does not overturn.

Clearly, the present invention may be embodied in other ways than the shown embodiment. Thus, in view of the above account of the principle of the invention, it is obvious to a skilled person to provide other embodiments of engagement flanges than the one shown, and to adapt the basic principle for use in connection with other forms of building elements where the same problem of stability may occur.

What is claimed is:

1. A building element for a toy building set comprising a plurality of such building elements, said building elements comprising:

a box-shaped body part having a surface with a top side and an underside, a plurality of side faces extending downwardly from the underside of the surface, a plurality of coupling flanges arranged between the side faces, said coupling flanges extending downwardly from the surface at a distance which is smaller than the distance at which the side faces extend from the surface, a plurality of coupling studs arranged on the top side of the surface, each of said coupling studs having a top face positioned at a height above the top side of the surface which is greater than the difference between the distance at which the coupling flanges and the side faces extend from the surface, said coupling studs, said coupling flanges and said side faces being shaped such that the coupling studs of a building element engage, face-to-face, both the coupling flanges and the side faces of another building element after interconnection of the same, wherein a plurality of engagement means is arranged between the coupling flanges and the side faces, said engagement means being shaped and positioned in such a manner that said, engagement means form an engagement face which engages the top face of the coupling studs upon interconnection of two building elements.

2. A building element according to claim 1, further comprising at least four coupling studs positioned in a square pattern.

3. A building element according to claim 1 wherein the top face of the coupling studs is substantially planar and parallel with the surface of the building element.

4. A building element according to claim 1 wherein the coupling flanges are shaped as tubes positioned such that said coupling flanges engage four adjacent coupling studs on an adjacent substantially similar building element.

5. A building element according to claim 1 wherein the engagement means comprise a plurality of engagement flanges which extend from the underside of the surface and downwardly at a distance which corresponds to the difference between the distance of the side faces from the surface and the height of the coupling studs.

6. A building element according to claim 5, wherein the engagement flanges are directly connected with the coupling flanges and extend at an angle out from the coupling flanges.

7. A building element according to claim 1 wherein the engagement faces are positioned on the coupling flanges where the coupling studs of a first building element touch the coupling flanges of a second building element, adjacent to and substantially similar to said first building element upon interconnection of the first and second building elements.

8. A building element according to claim 7, wherein the coupling tubes are shaped substantially cylindrical tubes.

* * * * *